United States Patent [19]

Youhouse

[11] 4,000,994

[45] Jan. 4, 1977

[54] ELECTROSTATIC PRECIPITATION APPARATUS FOR VEHICLE ENGINE EXHAUST

[76] Inventor: Joseph Youhouse, 11941 SW. 43rd St., Miami, Fla. 33175

[22] Filed: Feb. 10, 1975

[21] Appl. No.: 548,511

Related U.S. Application Data

[63] Continuation-in-part of Ser. No. 436,134, Jan. 24, 1974, abandoned.

[52] U.S. Cl. ..... 55/112; 55/138; 55/149; 55/154; 55/151; 55/429; 55/DIG. 30; 60/311

[51] Int. Cl.[2] ..... B03C 3/16

[58] Field of Search ..... 55/299, 300, 13, 14, 55/429, 108, 109, 112, 121, 113, 126, 127, 145, 149, 150, 151, 154, DIG. 30; 60/275, 311

[56] References Cited

UNITED STATES PATENTS

| | | | |
|---|---|---|---|
| 1,394,771 | 10/1921 | Kennard | 55/145 |
| 2,631,687 | 3/1953 | Dohrer | 55/108 |
| 3,157,479 | 11/1964 | Boles | 55/154 |
| 3,181,285 | 5/1965 | Tepolt et al. | 55/145 |
| 3,587,213 | 6/1971 | Tammy et al. | 55/300 |
| 3,929,436 | 12/1975 | Kim et al. | 55/138 |

FOREIGN PATENTS OR APPLICATIONS

| | | | |
|---|---|---|---|
| 706,152 | 3/1954 | United Kingdom | 55/150 |

*Primary Examiner*—Bernard Nozick
*Attorney, Agent, or Firm*—Oltman and Flynn

[57] ABSTRACT

An electrostatic precipitation apparatus for removing polluting components from the exhaust of internal combustion engines and other fossil fuel burners. The apparatus reduces the velocity of the exhaust gases while subjecting them to a high potential electric charge and reduces the velocity still further while precipitating the resultant electrically charged polluting components on a plurality of rotating discs which are vibrated transversely and wiped off to remove the polluting component material into a removable reservoir.

6 Claims, 12 Drawing Figures

ELECTROSTATIC PRECIPITATION APPARATUS FOR VEHICLE ENGINE EXHAUST

This application is a continuation-in-part of my copending application, Ser. No. 436,134, filed Jan. 24, 1974 now abandoned.

BACKGROUND OF THE INVENTION

It has been known heretofore that carbon monoxide in the exhaust from an internal combustion engine can be converted to harmless carbon dioxide by causing it to flow over an electrically heated coil. However, this has little or no beneficial effect on other noxious components which may be present in the exhaust, such as oxides of nitrogen, sulfur and lead.

Electrostatic precipitators have been used for removing undesired impurities in the air or in various gases. For example, U.S. Pat. No. 3,558,286 shows such a precipitator for removing impurities present in the exhaust from an internal combustion engine on a vehicle.

SUMMARY OF THE INVENTION

The present invention is directed to a novel apparatus for removing impurities present in the exhaust from an internal combustion engine or other hydrocarbon combustion device. In the preferred embodiment, this apparatus includes a convoluted coil in the path of the engine exhaust to which a high negative voltage is applied, so that noxious constituents in the exhaust become negatively charged. This coil is positioned in a housing chamber whose cross-sectional area is substantially larger than that of the exhaust pipe leading into it, so that the velocity of the exhaust is greatly reduced as it flows past the coil. Immediately behind this chamber a plurality of parallel discs rotate in an even larger chamber, with the plane of each disc extending in the direction of the flow of the exhaust. The discs are grounded and, as a result of the further reduction of the gas velocity in this chamber and the relatively long flow path past each disc, the charged polluting constituents accumulate on the discs. Wipers are associated with the discs and the discs are vibrated laterally, both for the purpose of removing the polluting constituents from the discs so that they fall into a receptacle below.

A principal object of this invention is to provide a novel and improved appratus for removing noxious impurites in the exhaust from an internal combustion engine by electrostatic precipitation.

Another object of this invention is to provide such an apparatus which reduces the velocity of the exhaust gases while the impurities are being electrically charged.

Another object of this invention is to provide such an apparatus which reduces the velocity of the exhaust gases while the previously charged impurities are being collected.

Another object of this invention is to provide such an apparatus having a convoluted coil arranged to charge the impurities as the exhaust flows through a chamber having a cross-sectional area effective to reduce the velocity of the incoming exhaust, and, immediately behind that chamber, a plurality of collectors of large surface area which do not significantly impede the flow of the exhaust and which are located in a chamber having a cross-sectional area effective to further reduce the velocity of the exhaust as it flows past these collectors and is attracted to them electrostatically.

Another object of this invention is to provide such an apparatus having a novel arrangement for the removal of accumulated impurities from the collectors.

Further objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 1:
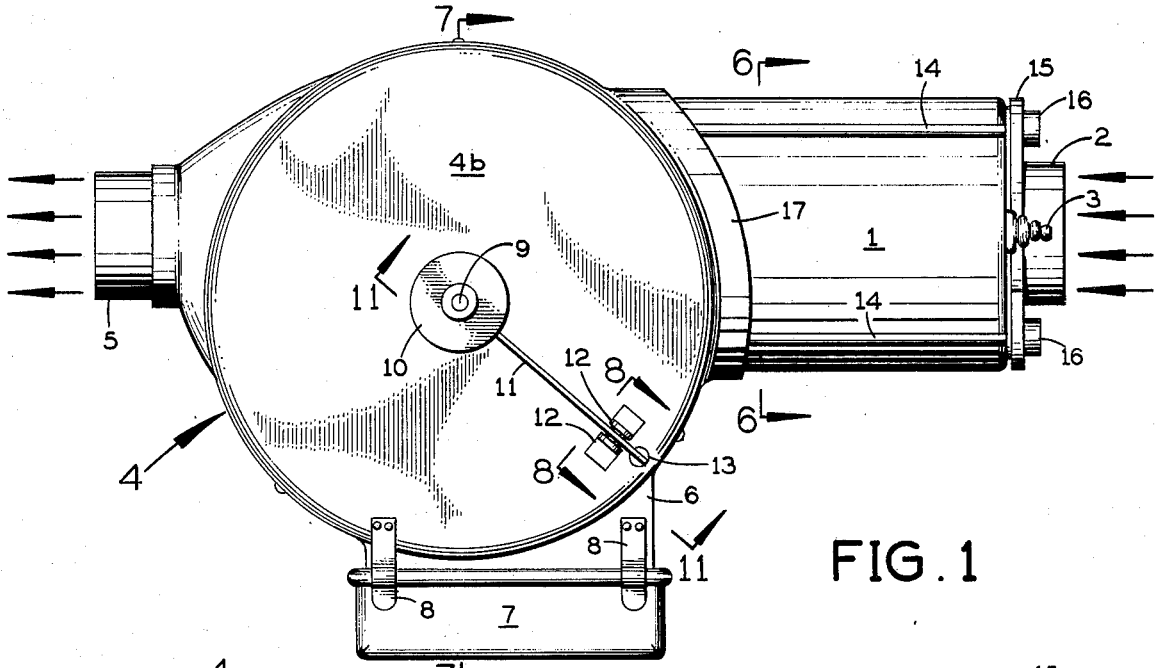
FIG. 1 is a side elevation of the present apparatus on a reduced scale.

Referring first to FIG. 1, the right hand portion of the apparatus contains high voltage electrodes within a ceramic cyclindrical chamber 1 on which is secured an exhaust pipe inlet 2. One of the high voltage insulators 3 is also shown. The chamber formed by cylinder 1 is secured to a generally cylindrical housing 4 which terminates in an exhaust pipe outlet 5. A downwardly extending, generally rectangular opening is formed by an integral rectangular extension 6 extending from the lower circular side of housing 4. A residue collection container 7 is sealed over the opening by four spring clips 8—8, two of which are shown. This side view also shows a transverse driven shaft 9 and a multiple tooth cam 10 and a cam follower 11 which is pivotally secured to brackets 12—12, which are adapted to drive the shaft 13 of a vibrator assembly, to be hereinafter described.

Figure 2:
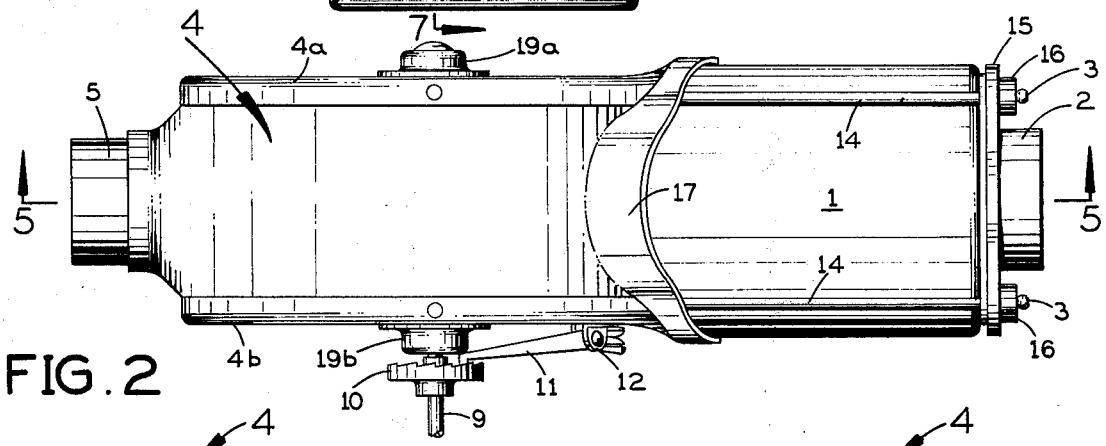
FIG. 2 is a top plan view of the apparatus shown in FIG. 1.

FIG. 2 is a top view of the device shown in FIG. 1 which clearly illustrates the four rods 14, two of which are shown in FIG. 1 and a flanged closure 15 which is retained by integral heads 16 threaded on the ends of the rods 14. The cylindrical inlet 2 is provided as a connection to the source of gas, such as the exhaust line from the internal combustion engine on an automobile or truck.

FIG. 1 and 2 illustrate an irregular flange 17 into which the inner edge portion of the cylinder 1 is fitted and sealed.

Figure 3:
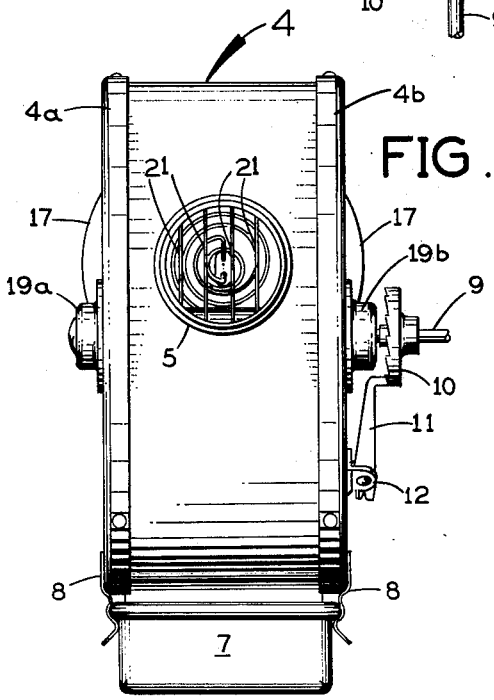
FIG. 3 is a rear elevation of the apparatus shown in FIG. 1.
Figure 4:
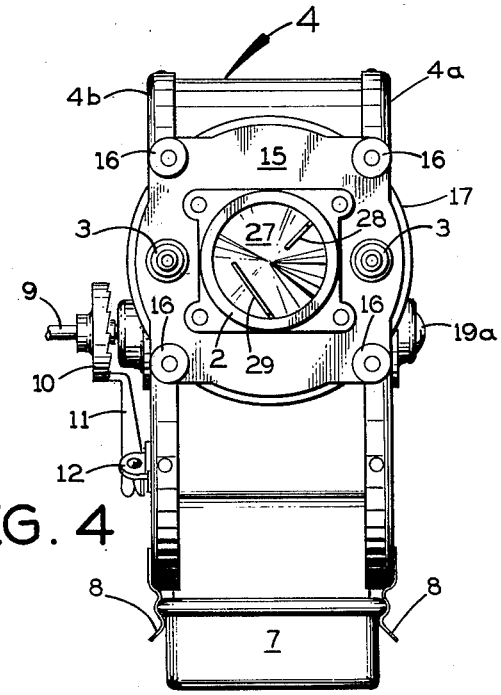
FIG. 4 is a front elevation of the apparatus shown in FIG. 1.

The rear elevations shown in FIGS. 3 and 4 illustrate the opposite clips 8, not shown in FIG. 1, and the exhaust inlet 5 permits a view of four of the eight discs 18, to be herinafter described, as well as rear view of the irregular flange 17 and other components clearly shown in FIGS. 1 and 2, including the bearing supports 19*a* and 19*b* for the rotation of the discs 18, shown. The circular sides 4*a* and 4*b* of the housing 4 and the bearing supports 19*a* and 19*b* are welded to the main body of the housing 4. Exhaust inlet 2 is integral with the closure 15 which is sealed to the end of the cylinder 1 with a suitable gasket therebetween. A pair of ceramic insulators 3 are shown secured in the plate 15 for retaining the ends of the charging electrodes, to be hereinafter described.

Figure 5:
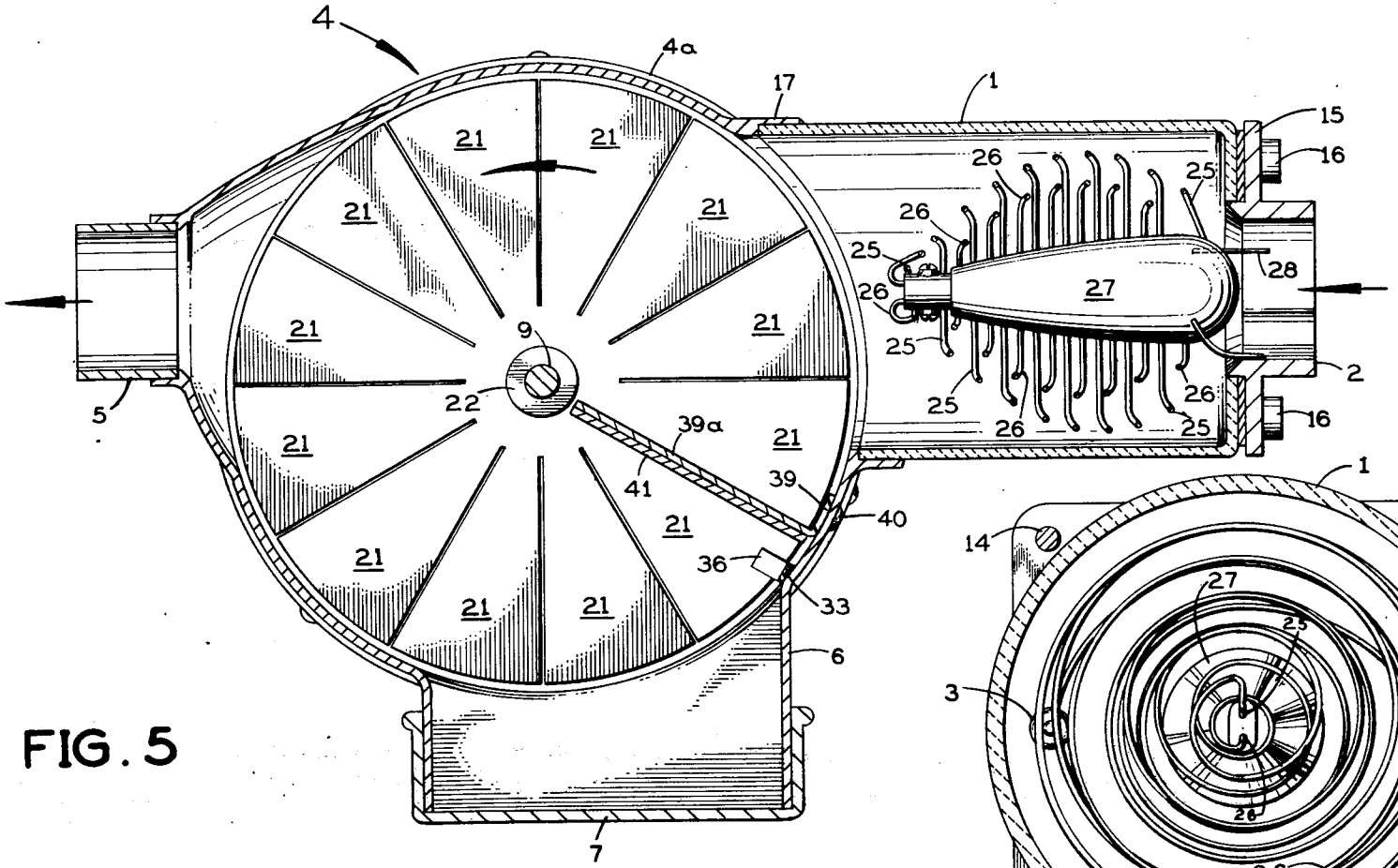
FIG. 5 is an enlarged cross-sectional side elevation taken through section line 5—5, FIG. 2.
Figure 10:
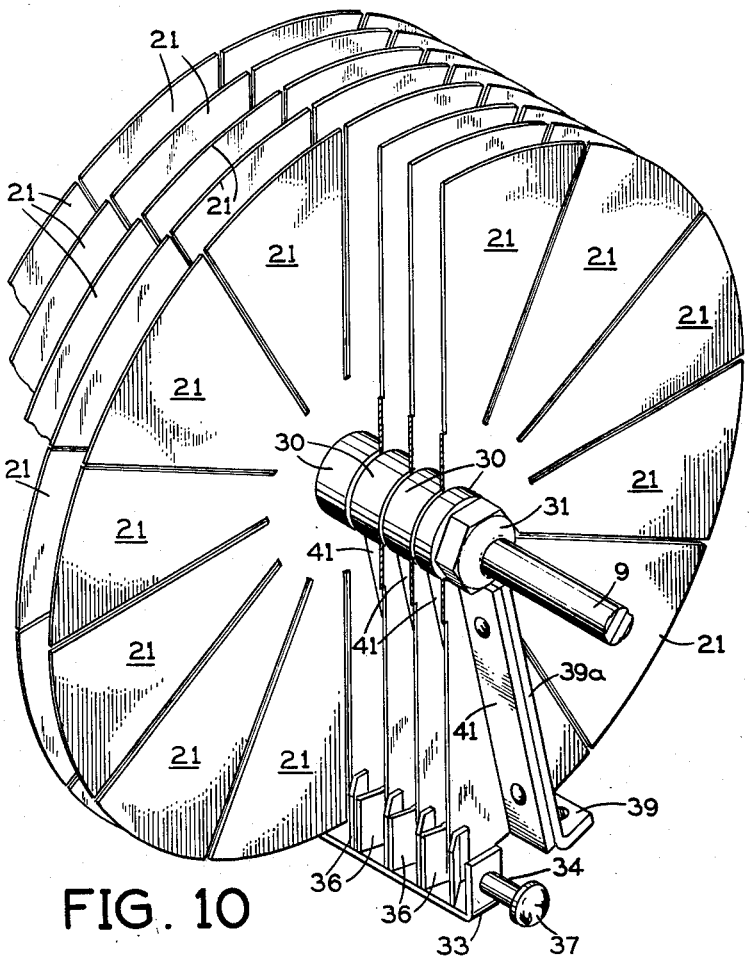
FIG. 10 is a fragmentary perspective view of the radially slotted discs shown in FIGS. 5 and 7.

FIG. 5 is approximately half scale of a moderate size unit and clearly shows in end elevation the inner elements of the device, such as a plurality of collector discs 18, preferably made of relatively flexible stainless steel. As shown in FIG. 10, each disc 18 is divided by radial slots into elements 21 which are secured to transverse shaft 9 by combination hubs and spacers 22. A spacer assembly 23 is secured at each extremity by a screw 24.

It is to be understood that under certain conditions the slots may be omitted from the discs, provided the discs have sufficient flexibility to be vibrated.

In accordance with one aspect of the present invention, for charging the noxious impurities in the exhaust a pair of convoluted electrically conductive coils 25 and 26 (FIG. 5) are positioned inside a first housing chamber which is provided by the cylinder 1. These coils are the charging electrodes in the apparatus. Both coils are supported by a ceramic core 27 of streamlined configuration, presenting a relatively blunt, rounded front end facing toward the exhaust inlet 2 and against which the engine exhaust impinges as it comes through the inlet 2 in the direction indicated by the arrow in FIG. 5. Behind this rounded front end, the core is tapered inwardly along its length to the left in FIG. 5. In addition to providing a physical support for the coils 25 and 26, this core performs the function of deflecting the exhaust laterally outward to flow through the convolutions of the coils 25 and 26. The ceramic core 27 is retained coaxially inside the first housing chamber by rods 28 and 29, which are welded or otherwise suitably attached to the inside of the inlet pipe 2.

Figure 6:
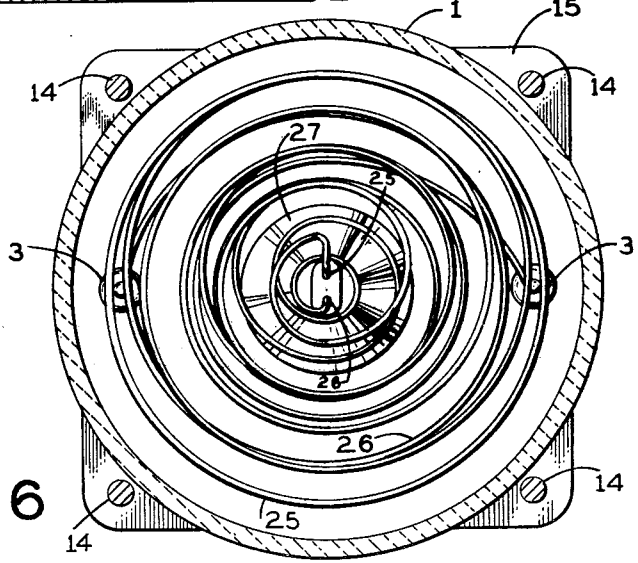
FIG. 6 is a cross-sectional end elevation taken through section line 6—6, FIG. 1.

At its back end the core 27 provides an open-circuited common terminal for the back ends of both coils 25 and 26. At their front ends both coils are connected to a suitable source of high D. C. voltage, preferably of negative polarity. For example, this voltage source may comprise the ignition coil of the vehicle engine and a rectifier which is connected between this ignition coil and the coils 25, 26. The front ends of the coils 25, 26 are supported by the insulators 3, as sown in FIG. 6. In one practical embodiment, the D. C. voltage on coils 25 and 26 is about 25,000 volts, which is sufficient to produce a corona discharge from the coils for applying a negative electrical charge to the noxious impurities in the exhaust flowing past these coils.

It will be evident from FIG. 5 that the successive turns or convolutions of the coils are arranged at different radial positions within the cylinder 1, and both coils are relatively long in an axial direction (the general direction of the exhaust gas flow from right to left in FIG. 5). Consequently, the exhaust gas is sufficiently exposed to the corona discharge from the coils so that the impurities to be removed are effectively charged negatively within cylinder 1.

In addition, the cross-sectional area of the first housing chamber (inside the cylinder 1) through which the exhaust flows around the central core 27 and past the convoluted coils 25, 26 is substantially greater than that of the inlet 2 and the vehicle engine exhaust line to which the inlet 2 is connected. Consequently, in cylinder 1 there is a proportionate reduction in the gas velocity, and this slow-down of the exhaust as it flows past the coils 25, 26 helps to insure that the impurities will become adequately charged, as described. In one practical imbodiment, the inside diameter of cylinder 1 may be about 4.6 inches, the maximum diameter of the central core 27 may be less than 2 inches, and the inside diameter of the inlet 2 is 2 inches. With this arrangement, the maximum velocity inside cylinder 1 will be less than one-fourth the velocity of the incoming exhaust gases, and along most of the length of the cylinder the velocity will be even slower (due to the greater flow area because of the progressively reduced cross-section area of the core 27).

Accordingly, it will be understood that the flow-deflecting action of the core 27, the length and disposition of the high potential coils 25, 26 and the velocity reduction provided by the relatively large cross-sectional area of the flow path inside cylinder 1 all combine to insure that the impurities in the exhaust will be subjected effectively to the corona discharge from coils 25, 26.

Preferably the electrode coils 25 and 26 are formed from corrosion resistant wire. The entire chamber 1 is secured by plate 15 and screw heads 16.

Figure 7:
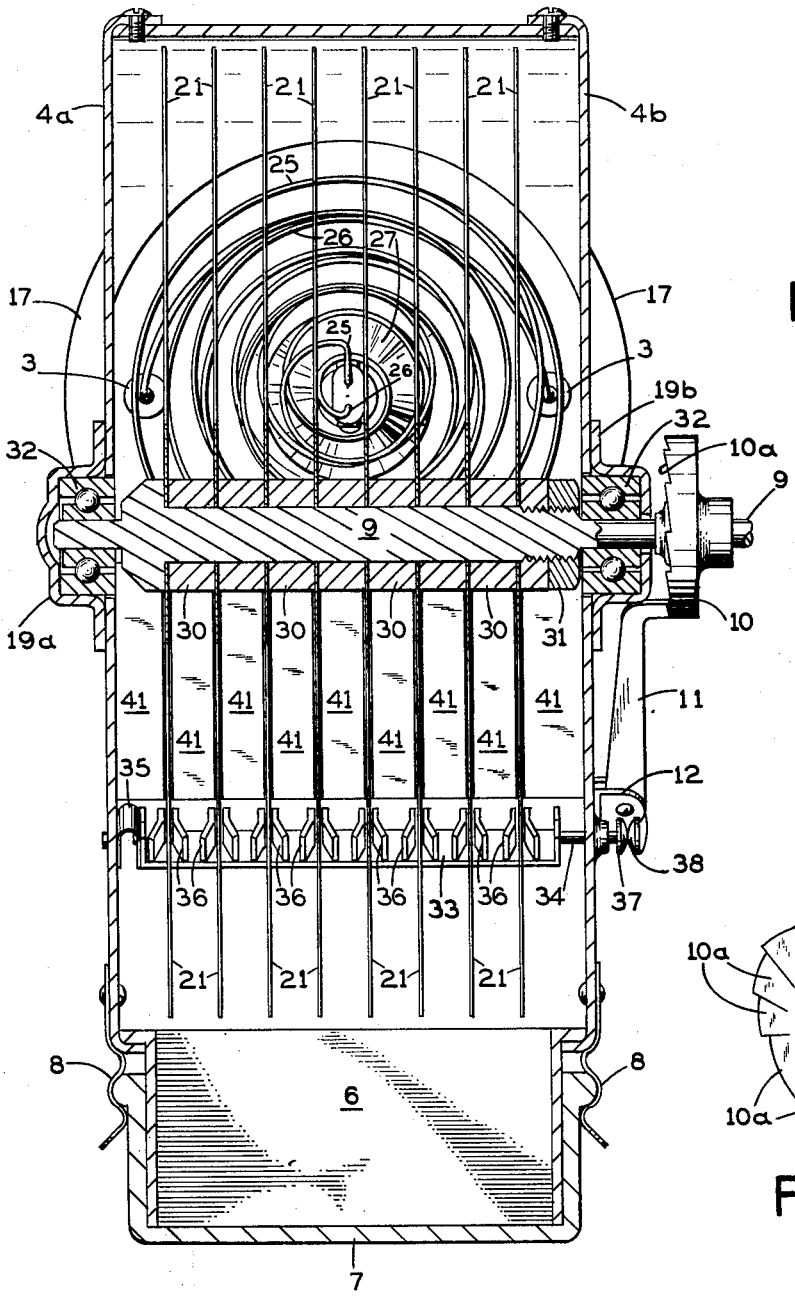
FIG. 7 is a cross-sectional end elevation taken through section line 7—7, FIG. 1.

FIG. 7 illustrates important elements of the device wherein the shaft 9 secures eight discs 18 in equispaced, parallel position by means of spacers 30 which are retained by a nut 31 threaded on the shaft, as shown. The shaft is supported on opposite ends by like ball bearing assemblies 32—32 which provides for the rotation of the blades and the cam 10 by the outer end of the shaft 9 by well known means at speeds between 50–100 rpm. The shaft 9 may be driven by the vehicle engine whose exhaust is being electrostatically precipitated by the present apparatus, or by a separate electric motor. A vibrator bar 33 is supported by a shaft 34 extending through the driven side of the housing 4*b* and held in axial alignment with shaft 34 by a flat compression spring 35. The vibrator bar 33 carries a plurality of pairs of wiper members 36, preferably made from a heat-resistant elastomer impregnated with fiber-glass, with each pair in straddling squeegee contact with a corresponding disc 18. The shaft 34 terminates in a button 37 which is engaged by a like button 38 secured to the outer end of follower 11.

Figure 8:
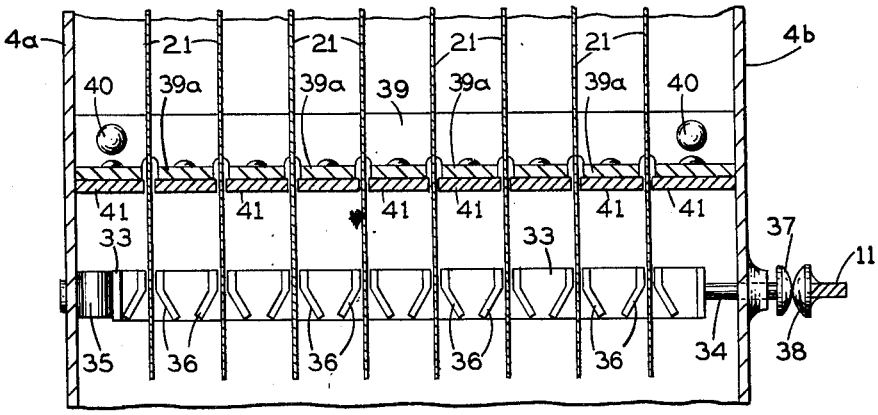
FIG. 8 is an angular cross-sectional view taken through section line 8—8, FIG. 1.

It will be evident that the discs 18 are of relatively large surface area and are supported with their major faces extending longitudinally of the direction of the exhaust gas flow. Consequently, each disc presents large surface areas exposed to the exhaust but positioned so as not to impede significantly the flow of the exhaust through a second housing chamber, at the inside of the housing 4. As best seen in FIG. 8, the discs 18 divide this second housing chamber into relatively narrow, longitudinal flow channels for the exhaust gases. All of the discs 18 are electrically grounded in any suitable fashion, so that the discs are electrically positive with respect to the negatively charged constituents in the exhaust.

In accordance with another aspect of this invention, the inside diameter of the housing 4 is substantially larger than that of the cylinder 1 in which the coils 25, 26 are located. Consequently, there is a further significant reduction of the gas velocity in the second housing chamber, and this, coupled with the large surface areas of the discs 18 exposed to the exhaust in this chamber and the relatively long flow paths past these discs, insures that the negatively charged constituents in the exhaust will be attracted electrostatically to the discs and will be deposited on the major faces of the discs.

It will be noted also that the housing 4 for the discs is attached directly to the cylinder 1 and the front ends of the discs 18 are close behind the back ends of the charging coils 25, 26. Consequently, the charged particles need not travel very far before they become electrostatically attracted to the grounded discs.

Figure 9:
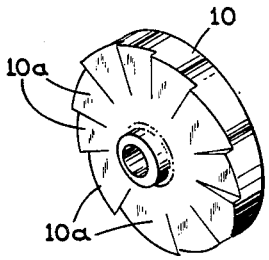
FIG. 9 is an enlarged perspective view of a vibration element shown in FIG. 7.

FIG. 7, 8 and 9 show the cam 10 and the sloping teeth 10*a* thereon which provide a sharp vibrating action to bar 33 in a direction perpendicular to the plane of each disc 18 when shaft 9 is rotated, whereby to shake off particulate solids from the rotating discs 18 to drop by gravity into the container 7.

Referring to FIG. 8, a barrier reinforcement bar 39 is secured transverse to the inner side of housing 4 by rivets 40. Bar 39 is positioned just beyond the peripheries of the discs 18. The reinforcing bar 39 carries a plurality of radially inwardly protruding arms 39*a* (FIG. 10), which extend between neighboring discs 18 and between the end discs and the respective end walls 4*a* and 4*b* of housing 4. A wiper bar 41 is attached to each arm 39*a* for squeegee contact with the adjacent disc or discs 18, so as to wipe off the impurity particles or droplets which were deposited on the discs during the preceding rotation of the discs.

Figure 11:
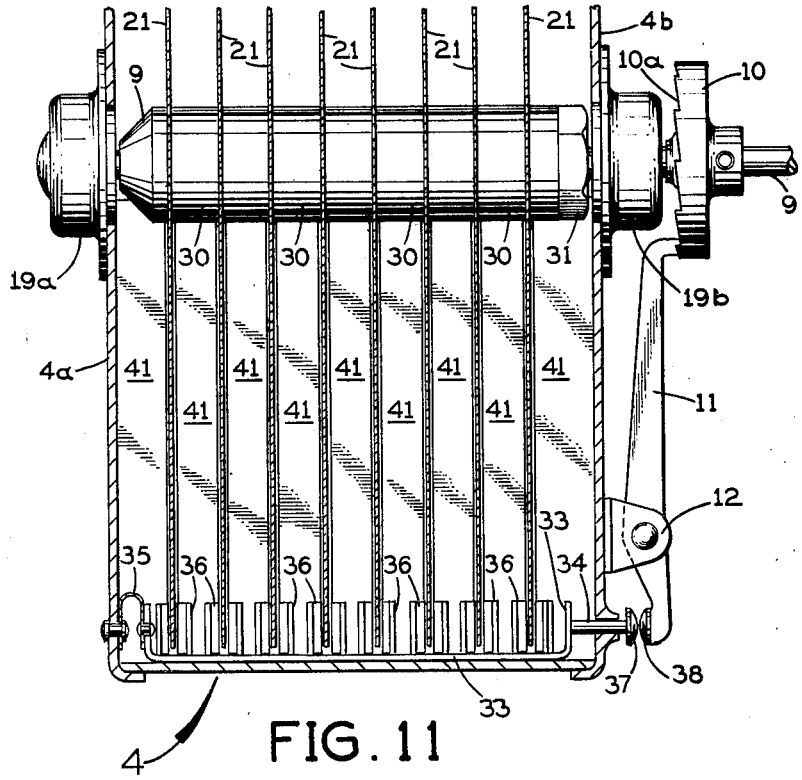
FIG. 11 is a fragmentary angular end elevation of the disc cleaning mechanism taken through section line 11—11, FIG. 1.

FIG. 11 illustrates the vibratory action means as the discs 18 pass through the wiper members 36 and are vibrated by the action of abutment 38 against abutment 37 for vibrating the bar 33.

Figure 12:
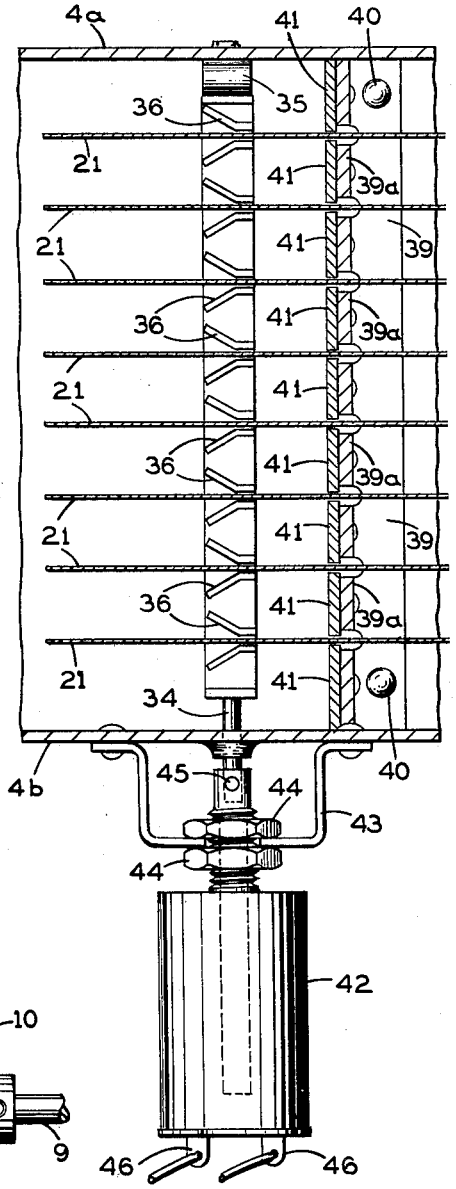
FIG. 12 is a cross-sectional view of an alternative particulate removing mechanism arrangement for use in the present apparatus.

FIG. 12 shows an alternative arrangement for vibrating the discs 18 which replaces the cam 10 and follower 11 by a solenoid type electro-magnet 42 retained by a bracket 43, retained by nuts 44. The core of the magnet is pivotally retained to the shaft 34 by a pin 45. When the terminals 46—46 are connected to a source of adjustable interrupted or alternating electric current, then the bar 33 will be vibrated by well known accurate electrical control means, not shown.

In operation and under the assumption that shaft 9 is rotated by a suitable power source, the eight discs 18 are rotated by the shaft at a speed between 50 and 150 rpm, the vibrator bar 33 is vibrated back and forth through a predetermined distance, the wiper members 37 bear against opposite sides of the discs to wipe the discs as they rotate past and also to vibrate or shake the rotating discs to assist in the removal of particulates from the discs, and the wiper members 41 also wipe off the discs as the discs rotate past.

The exhaust flowing in through the inlet 2 is deflected laterally outward by the central core 27 and flows around the outside of this core through the successive convolutions of the high voltage coils 25, 26. The gas velocity is reduced at this time, as already explained, to insure that impurities in the exhaust become electrically charged. The exhaust then flows into the housing 4, where it undergoes another velocity reduction, and it flows between the rotating discs 18. The electrically charged impurities are attracted to the discs and deposit themselves on the discs. The wipers 41 and 36 wipe these impurities off as the discs rotate past, and the vibrator bar 33 shakes the discs transversely to assist the removal of the charged impurities. These impurities, which may be both solid particles and liquid droplets, drop by gravity into the receptacle 7 below. The remaining components in the exhaust pass out through the discharge outlet 5.

Preferably, an electrically heated coil is located at the inlet side of the present apparatus for the purpose of converting carbon monoxide to carbon dioxide, particularly when the engine is cold.

If desired, the receptacle 7 may be provided with a remote-controlled closure on the bottom so that the vehicle driver may empty this receptacle simply by operating a pushbutton on the dashboard.

The radial slots in the discs 18 are advantageous in that the transverse vibration of the lower end of the discs is not imparted significantly to the upper end of the discs. Consequently, while the accumulated impurity particles are being shaken off the discs at the bottom, the upper ends of the discs, which are exposed to the exhaust coming from the charging chamber 1, are not vibrating significantly and the charged particles can adhere to the discs here.

I claim:

1. An apparatus for treating exhaust gases from an engine exhaust line, said apparatus comprising:

a first housing chamber having an inlet for attachment to said exhaust line and an outlet spaced from said inlet; convoluted coil means inside said first chamber having successive convolutions thereof spaced apart along the flow path through said first chamber from said inlet to said outlet, terminals for applying to said coil means a high DC voltage for charging impurities in the exhaust flowing past;

said first chamber having an open cross-sectional area which is substantially larger than that of the engine exhaust line, whereby to reduce the velocity of the exhaust as it flows past said coil means;

a second housing chamber having an inlet connected directly to the outlet of said first chamber and having an outlet spaced from said last-mentioned inlet;

a plurality of discs positioned in said second chamber with the plane of each disc extending substantially in the direction of the exhaust flow through said second chamber from said second chamber inlet to said second chamber outlet, said discs being at an electrical potential substantially different from that of said coil means whereby to electrostatically attract the charged impurities in the exhaust; and vibration means operatively coupled to said discs for removing the accumulated impurities therefrom.

2. Apparatus according to claim 1, and further comprising a core mounted inside said first housing chamber and positioned substantially centrally inside the convolutions of said coil means, said core having a convex end facing toward said inlet of the first chamber for deflecting the incoming exhaust laterally outward toward the convolutions of said coil means.

3. Apparatus according to claim 2, wherein said second housing chamber has an open cross-sectional area which is substantially greater than that of the engine exhaust line, whereby to maintain a reduced velocity of the exhaust as it flows through said second chamber.

4. Apparatus according to claim 2, wherein said core extends lengthwise inside said first chamber between the latter's inlet and outlet, said convex end of the core is blunt and rounded, and said core is tapered inwardly to present a progressively reduced cross-section along its length away from said convex end and toward said outlet of the first chamber.

5. Apparatus according to claim 4, wherein:

said inlet to the second housing chamber is completely located substantially above the bottom of said chamber;

said outlet from the second housing chamber is at the opposite side thereof from said inlet and is completely located substantially above the bottom of said second housing chamber;

and said cllectors are rotatable discs, each rotating in said second housing chamber in a substantially vertical plane parallel to the direction of the exhaust flow through said second housing chamber, each of said discs extending substantially below said inlet and said outlet of the second housing chamber and being slitted transversely from its outer edge inward;

and further comprising:

means for transversely vibrating the discs at a location thereon below said inlet and said outlet of the second housing chamber to shake off the impurities from the lower portions of the discs without shaking off impurities from the upper portions of the discs because of the slits therein.

6. An apparatus for treating exhaust gases from an engine exhaust line, said apparatus comprising:

a first housing chamber having an inlet for attachment to said exhaust line and an outlet spaced from said inlet; charging electrode means inside said first housing chamber comprising convoluted coil means having successive convolutions thereof extending along the flow path through said chamber from said inlet to said outlet and having terminal means for receiving a high DC voltage of a single polarity to cause said coil means to electrically charge with said polarity impurities in the exhaust flowing past;

said first housing chamber having an open cross-sectional area which is substantially larger than that of the engine exhaust line whereby to reduce the velocity of the exhaust as it flows past said charging electrode means;

a second housing chamber having an inlet connected to receive the exhaust flow from the outlet of said first housing chamber and having an outlet spaced from said last-mentioned inlet, said second housing chamber having an open cross-sectional area which is substantially larger than that of the engine exhaust line whereby to keep the velocity of the exhaust flow reduced;

a plurality of collectors located in said second housing chamber and having a polarity and electrical potential effective to electrostatically attract the charged impurities in the exhaust;

and means operatively coupled to said collectors for removing the accumulated impurities therefrom;

said inlet to the second housing chamber being completely located substantially above the bottom of said chamber;

said outlet from the second housing chamber being at the opposite side thereof from said inlet and completely located substantially above the bottom of said second housing chamber;

and said collectors being rotatable discs, each rotating in said second housing chamber in a substantially vertical plane vertical to the direction of the exhaust flow through said second housing chamber, each of said discs extending substantially below said inlet and said outlet of the second housing chamber and being slitted transversely from its outer edge inward;

and further comprising:

means for transversely vibrating the discs at a location thereon below said inlet and said outlet of the second housing chamber to shake off the impurities from the lower portions of the discs without shaking off impurities from the upper portions of the discs because of the slits therein.

* * * * *